US006655353B1

(12) United States Patent
Rayl

(10) Patent No.: US 6,655,353 B1
(45) Date of Patent: Dec. 2, 2003

(54) CYLINDER DEACTIVATION ENGINE CONTROL SYSTEM WITH TORQUE MATCHING

(75) Inventor: Allen B. Rayl, Waterford, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 10/150,883

(22) Filed: May 17, 2002

(51) Int. Cl.[7] ..... F02M 7/00
(52) U.S. Cl. ..... 123/436; 123/481; 123/198 F
(58) Field of Search ..... 123/198 F, 481, 123/352, 361, 436

(56) References Cited

U.S. PATENT DOCUMENTS 5,151,861 A * 9/1992 Danno et al. ..... 701/90
5,374,224 A 12/1994 Huffmaster et al.
5,398,544 A 3/1995 Lipinski et al.
5,408,966 A 4/1995 Lipinski et al.
5,408,974 A 4/1995 Lipinski et al.
5,431,139 A 7/1995 Grutter et al.
5,437,253 A 8/1995 Huffmaster et al.
5,568,795 A 10/1996 Robichaux et al.
5,769,054 A 6/1998 Schnaibel et al.
5,992,382 A * 11/1999 Bruedigam et al. ..... 123/396
6,035,252 A * 3/2000 Dixon et al. ..... 701/102
6,081,042 A * 6/2000 Tabata et al. ..... 290/45
6,226,585 B1 * 5/2001 Cullen ..... 701/54
6,237,563 B1 * 5/2001 Froehlich et al. ..... 123/350
6,373,144 B2 * 4/2002 Frohlich et al. ..... 290/40 R
6,490,511 B1 * 12/2002 Raftari et al. ..... 701/22

FOREIGN PATENT DOCUMENTS

EP 0731265 A2 9/1996

OTHER PUBLICATIONS

Watanabe/Fukutani, SAE Technical Paper Series 820156, Cylinder Cutoff of 4–Stroke Cycle Engines at Part–Load and Idle, Feb. 22–26, 1982.

* cited by examiner

*Primary Examiner*—John T. Kwon
(74) *Attorney, Agent, or Firm*—Christopher DeVries

(57) ABSTRACT

An engine control system and method smoothes torque during transitions in a displacement on demand engine. A torque loss estimator generates a torque loss signal based on torque loss due to at least one of friction, pumping and accessories. A pedal torque estimator generates a pedal torque signal. An idle torque estimator generates an idle torque signal. A summing circuit generates a difference between the pedal torque signal and the idle torque and the torque loss signals and outputs a desired brake torque signal.

25 Claims, 5 Drawing Sheets

CYLINDER DEACTIVATION ENGINE CONTROL SYSTEM WITH TORQUE MATCHING

FIELD OF THE INVENTION

The present invention relates to engine control systems for internal combustion engines, and more particularly to torque matching in a cylinder deactivation engine control system.

BACKGROUND OF THE INVENTION

Some internal combustion engines include engine control systems that deactivate cylinders under low load situations. For example, an eight cylinder can be operated using four cylinders to improve fuel economy by reducing pumping losses. Fuel economy improvement of approximately 5–10% can be realized.

To smoothly transition between activated and deactivated modes, the internal combustion engine must produce torque with a minimum of disturbances. Otherwise, the transition will not be transparent to the driver. In other words, excess torque will cause engine surge and insufficient torque will cause engine sag, which degrades the driving experience.

Conventional engine control systems that provide torque smoothing have been based on brake torque and as calibrated spark. Engine control systems using this approach does not account for changes in engine and environmental conditions. This approach also does not meet drivability specifications for maximum torque disturbances allowed during transitions between activated and deactivated modes.

SUMMARY OF THE INVENTION

An engine control system and method smoothes torque during transitions in a displacement on demand engine. A torque loss estimator generates a torque loss signal based on torque loss due to at least one of friction, pumping and accessories. A pedal torque estimator generates a desired pedal torque signal. An idle torque estimator generates a desired idle torque signal. A summing circuit generates a difference between the pedal torque signal and the idle torque and the torque loss signals and outputs a desired brake torque signal.

In other features, a first switch selects one of activated and deactivated modes for the torque loss estimator. A second switch selects one of activated and deactivated modes for the idle torque estimator. A position of the first and second switches is based on an operating mode of the engine.

In yet other features, a first summing circuit sums the desired brake torque signal and the torque loss signal for the deactivated mode. A first multiplier multiplies an output of the first summing circuit and an air per cylinder (APC) correction signal to produce a first desired deactivated indicated torque signal. A second multiplier multiplies the output of the first summing circuit and a throttle area correction signal to produce a second desired deactivated indicated torque signal. A second summing circuit sums the desired brake torque signal and the torque loss signal for the activated mode. A third multiplier multiplies an output of the second summing circuit and the APC correction signal to produce a first desired activated indicated torque signal. A fourth multiplier multiplies the output of the second summing circuit and the throttle area correction signal to produce a second desired activated indicated torque signal.

In still other features, a first desired APC estimator estimates a desired deactivated APC from the first deactivated desired indicated torque signal. A second desired APC estimator estimates a desired activated APC from the first desired activated indicated torque signal. A third switch communicates with the first and second desired APC estimators and selects one of the desired deactivated APC signal and the desired activated APC signal based on the operating mode of the engine.

In still other features, a first desired area estimator estimates a desired deactivated area from the second deactivated desired indicated torque signal. A second desired APC estimator estimates a desired deactivated area from the second activated desired indicated torque signal. A fourth switch communicates with the first and second desired area estimators and selects one of the desired deactivated area signal and the desired activated area signal based on the operating mode of the engine.

In still other features, the idle airflow estimator includes an idle air per cylinder estimator that generates idle airflow signals for activated and deactivated modes based on engine rpm and idle airflow. A deactivated idle torque estimator receives the deactivated idle airflow signal and generates a deactivated idle torque signal. An activated idle torque estimator receives the activated idle airflow signal and generates an activated idle torque signal. A fifth switch selects one of the activated and deactivated idle airflow signals based on an operating mode of the engine.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
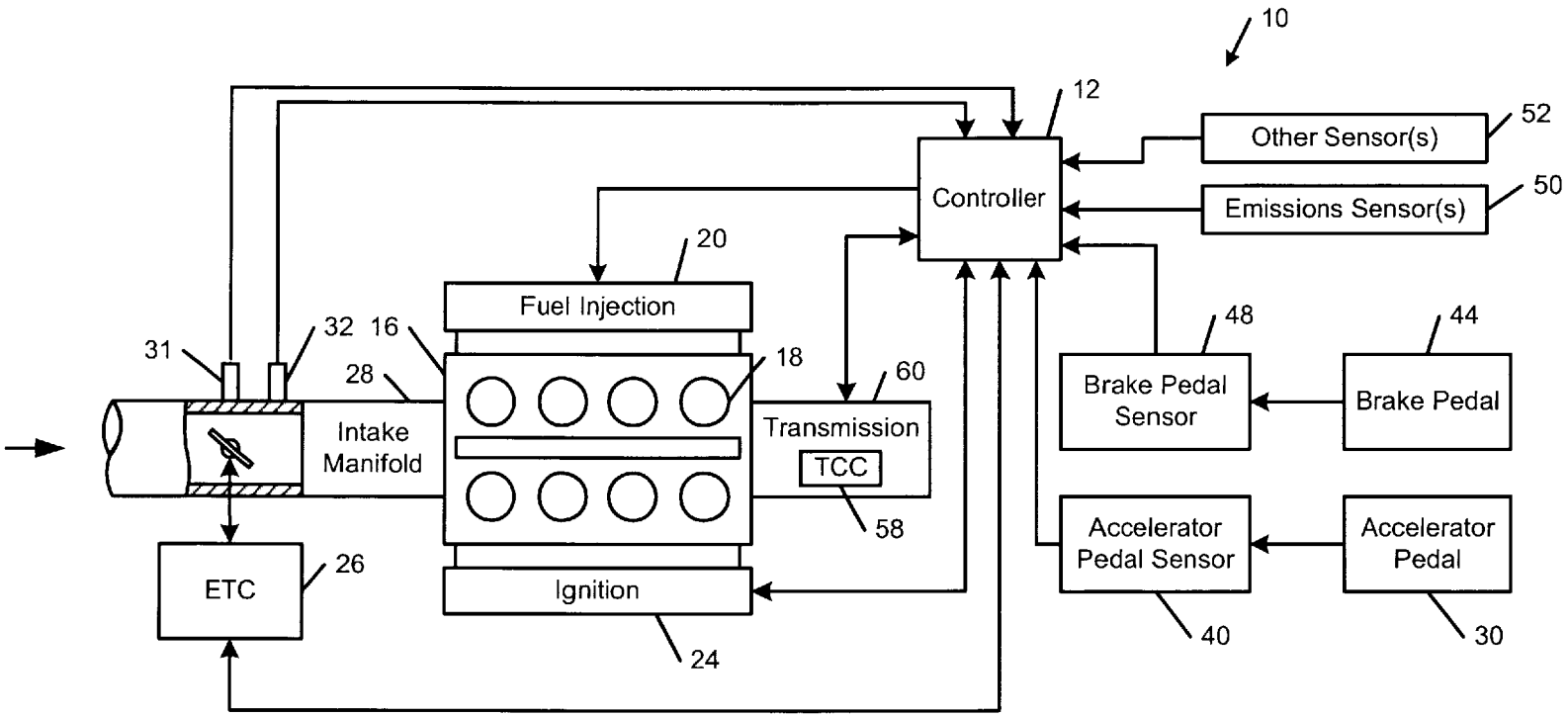
FIG. 1 is a functional block diagram of an engine control system that smoothes torque during cylinder activation and deactivation according to the present invention.

The following description of the preferred embodiment(s) is merely exemplary in nature and is in no way intended to limit the invention, its application, or uses. For purposes of clarity, the same reference numbers will be used in the drawings to identify similar elements. As used herein, activated refers to operation using all of the engine cylinders and deactivated refers to operation using less than all of the cylinders of the engine (one or more cylinders not active).

An engine control system according to the present invention delivers a desired indicated torque, taking into account known torque losses, and matches brake torque during transitions between deactivated and activated cylinder modes. The engine control system generates a desired air per cylinder ($APC_{Des}$) and a desired throttle area ($Area_{Des}$) for both activated and deactivated operating modes. The $APC_{Des}$ and $Area_{Des}$ signals smooth the transition between activated and deactivated modes. While the present invention will be described in conjunction with a V8 engine that transitions to a V4 mode, skilled artisans will appreciate that the present invention applies to engines having additional or fewer cylinders such as four, six, ten and twelve cylinder engines.

Desired indicated torque is based on the estimates for indicated idle torque, pedal brake torque, pumping torque, engine friction torque, AC compressor torque, accessory drive torque, and torque losses from spark retard. Idle torque is computed from desired idle airflow and engine mode (for example, 8 or 4 cylinder mode). Non-idle throttle area (total area in–idle area) is used to look-up driver pedal torque requested.

Torque losses are the sum of engine friction losses, AC compressor losses, accessory drive losses, and pumping losses. As pumping losses change between engine modes, estimated pumping losses for the opposite mode are estimated based on vacuum transfer function tables, models or other suitable methods. The pumping loss estimate is required because the desired throttle area and air per cylinder for the opposite mode are needed before the transition occurs.

Torque losses from spark retards are computed for each operating mode because the same spark reduction will impact brake torque differently in each mode. Torque loss is calculated from minimum spark advance for best torque (MBT). Desired indicated torque is calculated based on the pedal, idle, V4 losses, V8 losses, and losses from spark retard. V8 losses are held during the V8–V4 throttle pre-load phase to prevent changes in desired brake torque caused by changes in the pumping losses when opening the throttle. Finally, the desired indicated torque, corrected for atmospheric conditions, is used to look up desired throttle area and air per cylinder values.

Referring now to FIG. 1, an engine control system 10 according to the present invention includes a controller 12 and an engine 16. The engine 16 includes a plurality of cylinders 18 each with one or more intake valves and/or exhaust valves (not shown). The engine 16 further includes a fuel injection system 20 and an ignition system 24. An electronic throttle controller (ETC) 26 adjusts a throttle area in an intake manifold 28 based upon a position of an accelerator pedal 30 and a control algorithm that is executed by the controller 12 and/or the ETC 26. One or more sensors 31 and 32 such as a pressure sensor and/or an air temperature sense pressure and/or air temperature in the intake manifold 20.

A position of the accelerator pedal 30 is sensed by an accelerator pedal sensor 40, which generates a pedal position signal that is output to the controller 12. A position of a brake pedal 44 is sensed by a brake pedal sensor 48, which generates a brake pedal position signal that is output to the controller 12. Emissions system sensors 50 and other sensors 52 such as a temperature sensor, a barometric pressure sensor, and other conventional sensor and/or controller signals are used by the controller 12 to control the engine 16. An output of the engine 16 is coupled by a torque converter clutch 58 in a transmission 60 to front and/or rear wheels. As can be appreciated by skilled artisans, the transmission can be a manual transmission or any other type of transmission.

Figure 2:
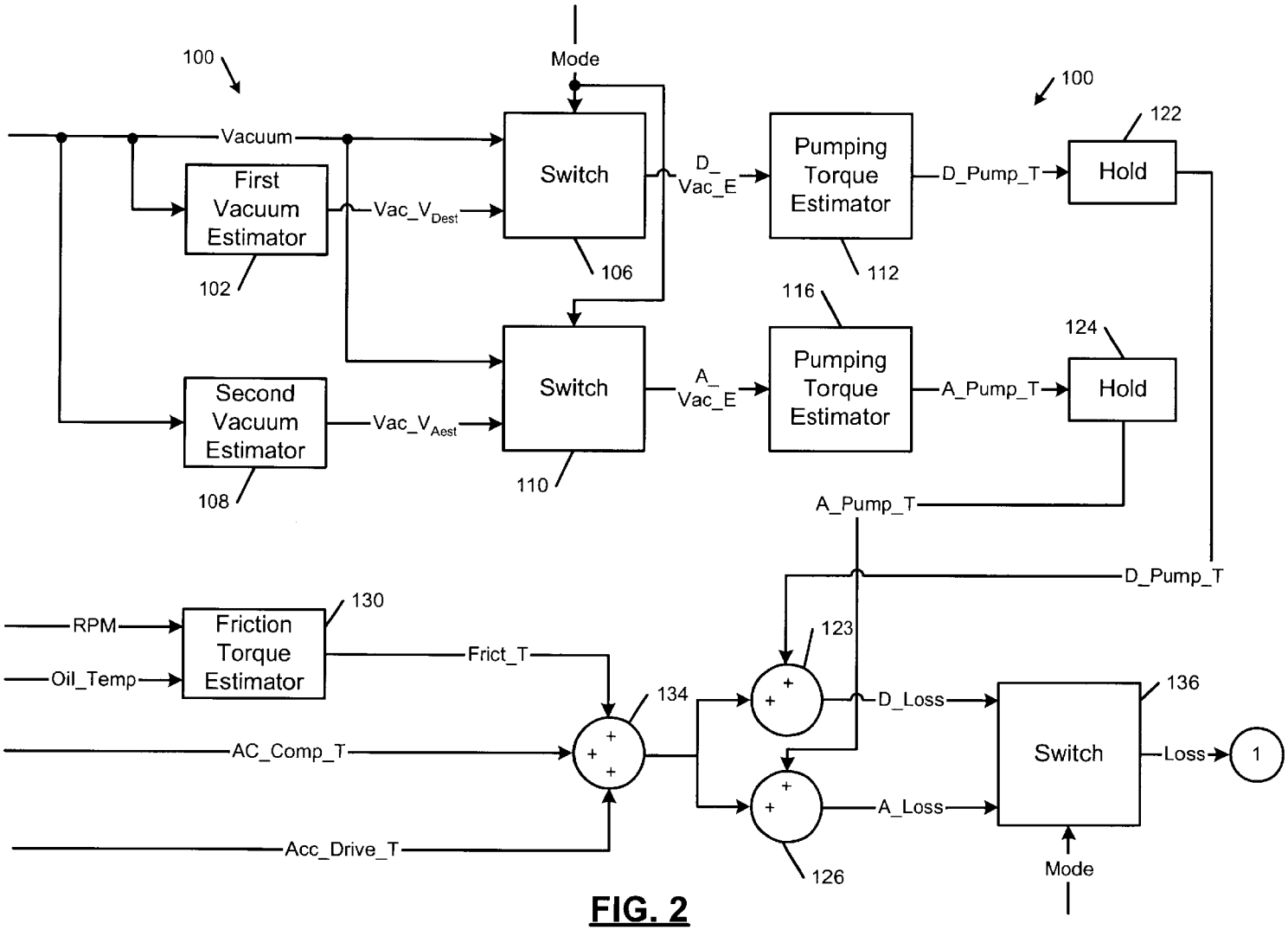
FIG. 2 is a functional block diagram of a torque loss estimator according to the present invention.

Referring now to FIG. 2, a torque loss estimator 100 according to the present invention is shown. A first vacuum estimator 102 estimates vacuum in a deactivated mode ($Vac_V_{Dest}$) from measured vacuum and outputs $Vac_V_{Dest}$ to a switch 106. A second vacuum estimator 108 estimates vacuum in an activated mode ($Vac_V_{Aest}$) from measured vacuum and outputs $Vac_V_{Aest}$ to a switch 110. Measured vacuum is also input to the switches 106 and 110. A mode signal is also input to the switches 106 and 110. When active, the mode signal toggles the switches 106 and 110. In other words, when the engine is in deactivated mode, the switch 106 selects the measured vacuum and the switch 110 selects $Vac_V_{Aest}$. When the engine is in activated mode, the switch 106 selects $Vac_V_{Dest}$ and the switch 110 selects the measured vacuum.

The switch 106 outputs an estimate of the vacuum for deactivated mode (D_Vac_E) to a pumping torque estimator 112. The pumping torque estimator 112 estimates pumping torque (D_Pump_T) for the deactivated mode based upon estimated vacuum D_Vac_E and outputs D_Pump_T to a hold circuit 122. The hold circuit 122 prevents changes in estimated pumping torques during a transition when the manifold vacuum is changing An output of the hold circuit 122 is input to a summing circuit 123. The switch 110 outputs an estimate of the vacuum in activated mode ($A_Vac_{13}$ E) to a pumping torque estimator 116. The pumping torque estimator 116 estimates pumping torque (A_Pump_T) for the activated mode based upon estimated vacuum A_Vac_E and outputs A_Pump_T to a hold circuit 124. An output of the hold circuit 124 is input to a summing circuit 126. Losses are expressed as negative torques.

A friction torque estimator 130 estimates friction torque (Frict_T) based upon engine rpm and oil temperature. The Frict_T, compressor torque (AC_Comp_T), and accessory drive torque (Acc_Drive_T) signals are summed by a summing circuit 134. An output of the summing circuit is input to the summing circuits 123 and 126. An output of the summing circuit 123 is equal to deactivated estimated torque loss (D_Loss). An output of the summing circuit 126 is equal to activated estimated torque loss (A_loss). The outputs of the summing circuits 123 and 126 are input to a switch 136 that selects one of D_Loss and A_Loss signals based upon an operating mode of the engine 16.

Figure 3:
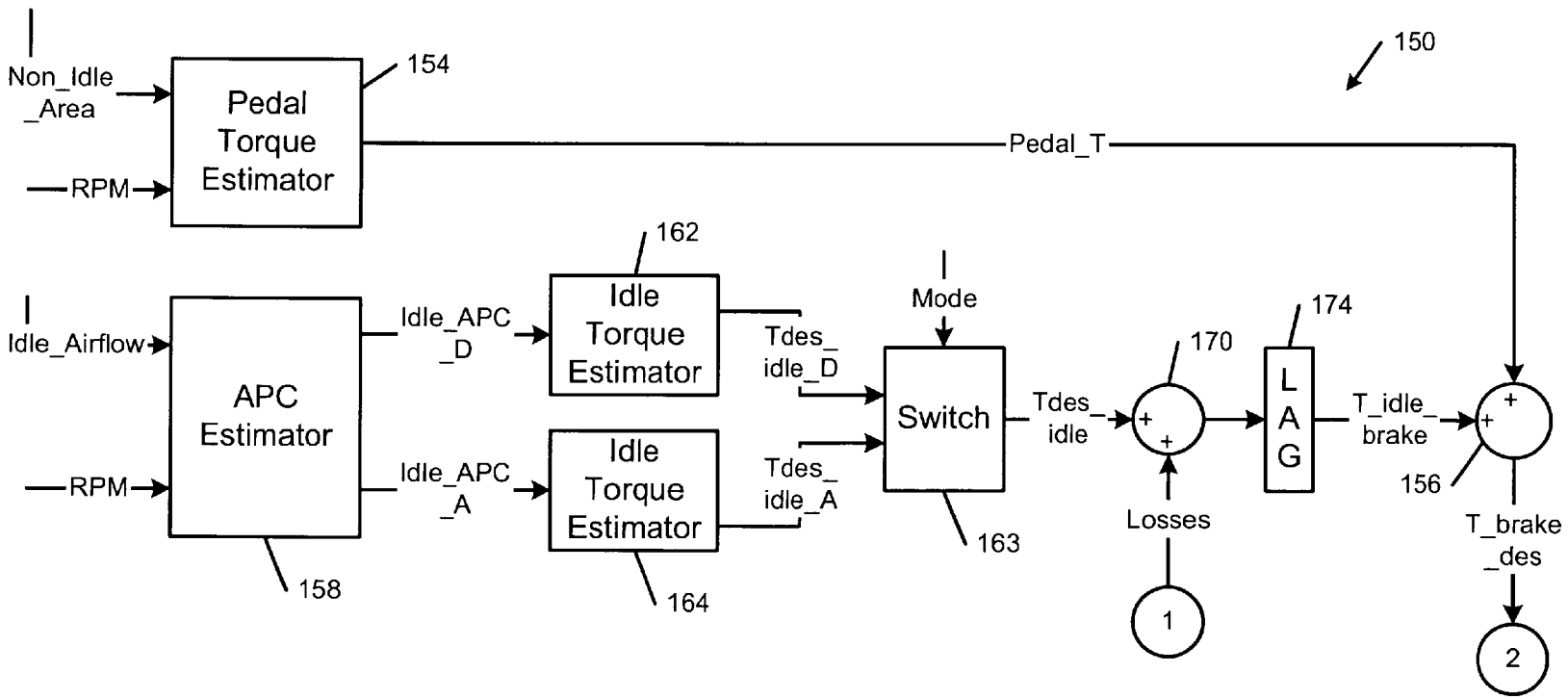
FIG. 3 is a functional block diagram of a desired brake torque estimator according to the present invention.

Referring now to FIG. 3, a desired brake torque estimator 150 is shown. A pedal torque estimator 154 estimates pedal torque (Pedal_T) based upon non-idle area and engine rpm. Non_Idle_Area is the total throttle area commanded less the Idle Area portion. Non_Idle_Area is typically equal to Pedal_Area or Cruise_Control_Area. The Pedal_T signal is input to a summing circuit 156. An air per cylinder estimator 158 estimates idle air per cylinder for activated and deactivated modes (Idle_APC_D, Idle_APC_A) based upon desired idle airflow and engine rpm.

Idle_APC_D is input to a first idle torque estimator 162, which outputs a desired idle torque for deactivated mode (Tdes_Idle_D) to a switch 163. Idle_APC_A is input to a first idle torque estimator 164, which outputs a desired idle torque for activated mode (Tdes_Idle_A) to the switch 163. The switch 163 selects one of Tdes_Idle_D and Tdes_Idle_A based upon the mode signal.

The switch 163 outputs an estimated desired idle indicated torque (Tdes_Idle) to a summing circuit 170. The engine torque losses output by the switch 136 are also input to the summing circuit 170. An output of the summing circuit is input to a lag filter 174. The Pedal_T and T_idle_brake signals are input to the summing circuit 156, which outputs a desired brake torque (T_brake_des).

Figure 4:
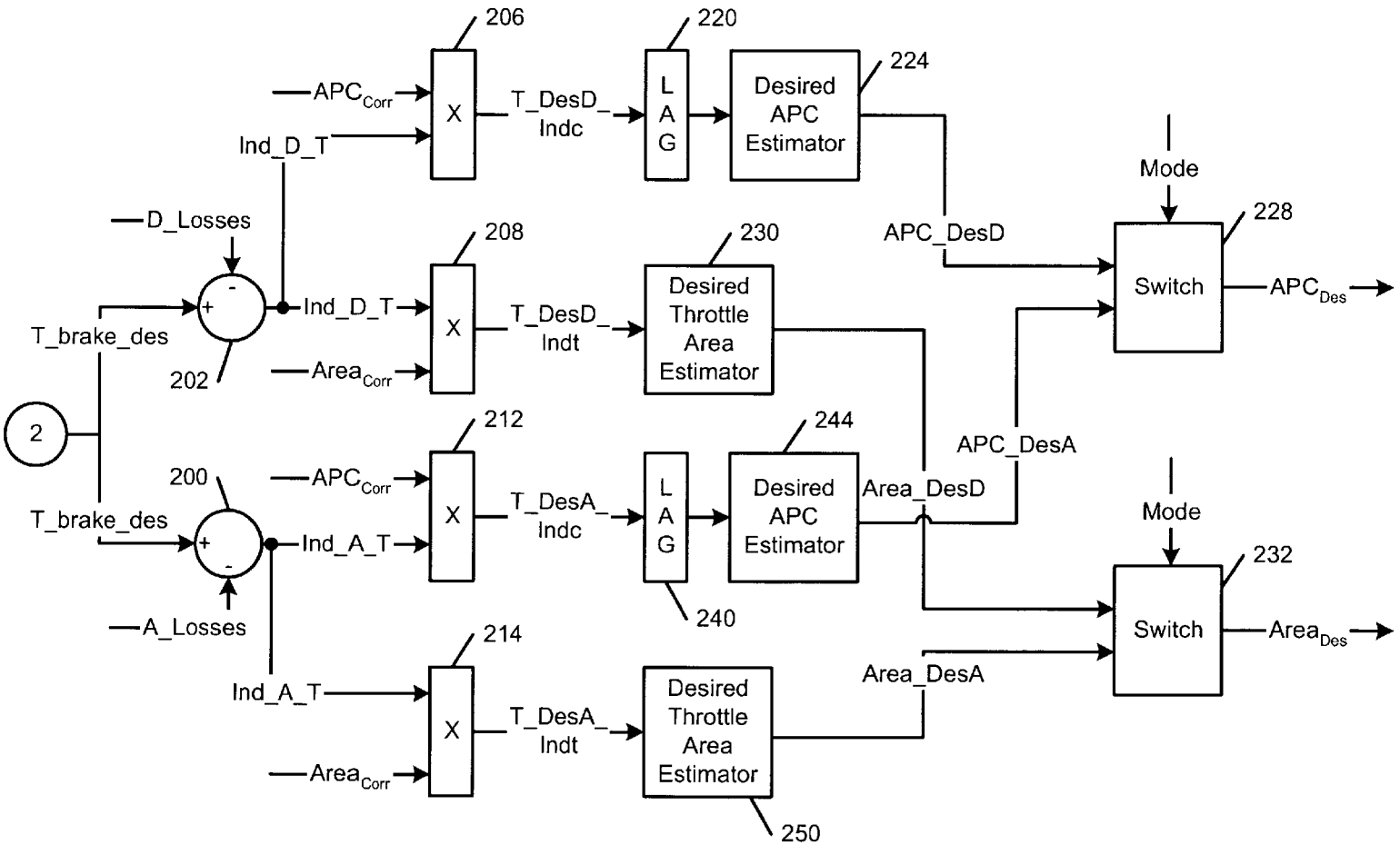
FIG. 4 is a functional block diagram of a desired air per cylinder and throttle area estimator.

Referring now to FIG. 4, T_brake_des is input to summing circuits 200 and 202. The D_Losses signal is input to an inverting input of the summing circuit 202. The summing circuit 202 generates a desired indicated deactivated torque (Ind_D_T), which is input to multipliers 206 and 208. A_Losses are input to an inverting input of the summing circuit 200. The summing circuit 200 generates a desired indicated activated torque (Ind_A_T), which is input to multipliers 212 and 214.

An air per cylinder correction term, preferably based on charge temperature and barometric pressure, is input to the multiplier 206. The multiplier outputs a desired deactivated indicated and corrected torque (T_DesD_Indc), which is input to a lag filter 220. The lag filter accounts for lag in intake manifold filling after throttle area changes. As can be appreciated, the lag filter can be positioned after the APC estimator. The output of the lag filter is input to a desired air per cylinder estimator 224, which estimates desired air per cylinder for deactivated mode (APC_DesD) from T_DesD_Indc. The APC_DesD signal is input to a switch 228. A throttle area correction term, preferably based on charge temperature and barometric pressure, is input to the multiplier 208. The multiplier 208 outputs a desired deactivated indicated torque (T_DesD_Indt), which is input to a desired throttle area estimator 230. An output of the desired throttle area estimator 230 is input to the switch 232. As can be appreciated by skilled artisans, the TdesD_Indc can be input to the desired throttle area and the throttle area can be corrected afterward.

An air per cylinder correction term, based on charge temperature and barometric pressure, is input to the multiplier 212. The multiplier 212 outputs a desired activated indicated and corrected torque (T_DesA_Indc), which is input to a lag filter 240. An output of the lag filter 240 is input to a desired air per cylinder estimator 244, which estimates desired air per cylinder for activated mode (APC_DesA) from T_DesA_Indc. The APC_DesA signal is input to the switch 228. A throttle area correction term, based on charge temperature and barometric pressure, is input to the multiplier 214. The multiplier 214 outputs a desired activated indicated torque (T_DesA_Indt), which is input to a desired throttle area estimator 250. An output of the desired throttle area estimator 250 is input to the switch 232.

The switch 228 selects between APC_DesD and APC_DesA depending upon the operating mode of the engine as reflected by the V4 mode signal. The switch 228 outputs a desired air per cylinder ($APC_{Des}$). The switch 232 selects between Area_DesD and Area_DesA based upon the operating mode of the engine as reflected by the mode signal. The switch 232 outputs a desired area ($Area_{Des}$). $Area_{Des}$ is preferably used by the ECT controller 26 to command the desired throttle area immediately. $APC_{Des}$ is used by a proportional integral (PI) controller in software to adjust the throttle area to match APC and torque.

Figure 5:
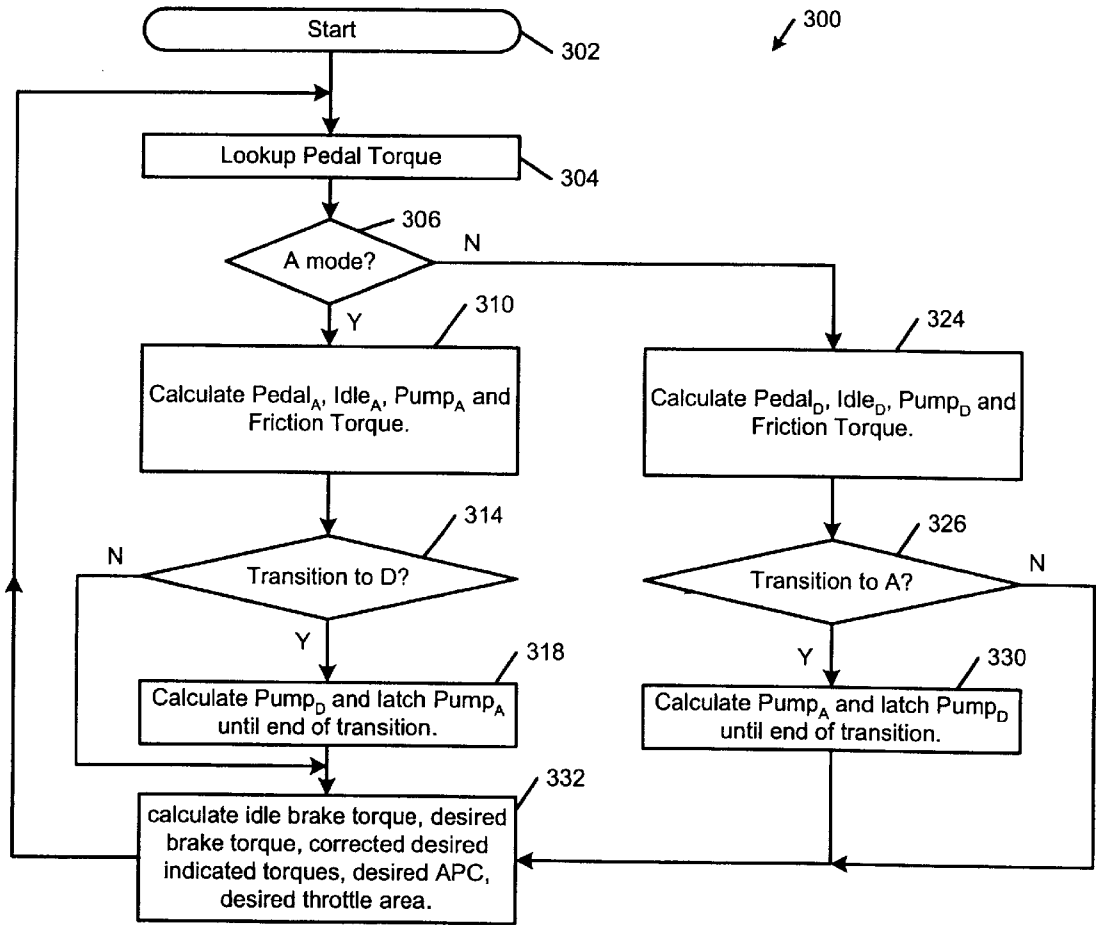
FIG. 5 is a flowchart illustrating steps performed by the engine control system to smooth torque during activation and deactivation transitions.

Referring now to FIG. 5, steps performed by the engine control system according to the present invention are shown generally at 300. Control begins with step 302. In step 304, the controller looks up pedal torque. In step 306, the controller determines whether the engine is operating in activated mode. If it is, control continues with step 310 and calculates pedal, idle, pump and friction torque for activated mode. Control continues with step 314 and determines whether the engine control system is transitioning from activated to deactivated mode. If it is, pumping torque for deactivated mode is calculated and pumping torque for activated mode is latched until the end of the transition in step 318.

If the engine is in deactivated mode, control continues with step 324 where the controller calculates pedal, idle, pumping and friction torque for deactivated mode. In step 326, control determines whether the engine is transitioning to activated mode. If true, control continues with step 330 and calculates pumping losses for activated mode and latches pumping losses for deactivated mode until the end of the transition. Control loops from steps 318, 330, 314 (if false) and 326 (if false) to step 332. After steps 318 and 330, idle brake torque, desired brake torque, corrected desired indicated torques, desired $APC_{Des}$ and $Area_{Des}$ are calculated in step 332. Control loops from step 332 to 304.

As can be appreciated by skilled artisans, the estimators 102, 108, 130, 112, 116, 154, 158, 162, 164, 224, 230, 244, and 250 can be implemented using look up tables (LUT), models or any other suitable method or device.

Airflow estimation is preferably performed using "Airflow Estimation For Engines with Displacement On Demand", GM Ref #: GP-300994, HD&P Ref #: 8540P-000029, U.S. Pat. Ser. No. 10/150,900, filed May 17, 2002, which is hereby incorporated by reference. Airflow estimation systems developed by the assignee of the present invention are also disclosed in U.S. Pat. Nos. 5,270,935, 5,423,208, and 5,465,617, which are hereby incorporated by reference.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, the specification and the following claims.

What is claimed is:

1. An engine control system for smoothing torque during transitions in a displacement on demand engine, comprising:

a torque loss estimator that generates a torque loss signal based on torque loss due to at least one of friction, pumping and accessories;

a pedal torque estimator that generates a desired pedal torque signal;

an idle torque estimator that generates a desired idle torque signal; and a summing circuit that generates a difference between said pedal torque signal and said idle torque and said torque loss signals and that outputs a desired brake torque signal.

2. The engine control system of claim 1 further comprising:

a first switch that selects one of activated and deactivated modes for said torque loss estimator.

3. The engine control system of claim 1 further comprising:

a second switch that selects one of activated and deactivated modes for said idle torque estimator.

4. The engine control system of claim 3 wherein a position of said first and second switches is based on an operating mode of said engine.

5. The engine control system of claim 4 further comprising:

a first summing circuit that sums said desired brake torque signal and said torque loss signal for said deactivated mode; and a first multiplier that multiplies an output of said first summing circuit and an air per cylinder (APC) correction signal to produce a first desired deactivated indicated torque signal.

6. The engine control system of claim 5 further comprising:

a second multiplier that multiplies said output of said first summing circuit and a throttle area correction signal to produce a second desired deactivated indicated torque signal.

7. The engine control system of claim 6 further comprising:

a second summing circuit that sums said desired brake torque signal and said torque loss signal for said activated mode; and a third multiplier that multiplies an output of said second summing circuit and said APC correction signal to produce a first desired activated indicated torque signal.

8. The engine control system of claim 7 further comprising:

a fourth multiplier that multiplies said output of said second summing circuit and said throttle area correction signal to produce a second desired activated indicated torque signal.

9. The engine control system of claim 8 further comprising:

a first desired APC estimator that estimates a desired deactivated APC from said first deactivated desired indicated torque signal;

a second desired APC estimator that estimates a desired activated APC from said first desired activated indicated torque signal; and a third switch that communicates with said first and second desired APC estimators and that selects one of said desired deactivated APC signal and said desired activated APC signal based on said operating mode of said engine.

10. The engine control system of claim 9 further comprising:

a first desired area estimator that estimates a desired deactivated area from said second deactivated desired indicated torque signal;

a second desired APC estimator that estimates a desired deactivated area from said second activated desired indicated torque signal; and a fourth switch that communicates with said first and second desired area estimators and that selects one of said desired deactivated area signal and said desired activated area signal based on said operating mode of said engine.

11. The engine control system of claim 1 wherein said idle airflow estimator includes:

an idle air per cylinder estimator that generates idle airflow signals for activated and deactivated modes based on engine rpm and idle airflow;

a deactivated idle torque estimator that receives said deactivated idle airflow signal and that generates a deactivated idle torque signal;

an activated idle torque estimator that receives said activated idle airflow signal and that generates an activated idle torque signal; and a fifth switch that selects one of said activated and deactivated idle airflow signals based on an operating mode of said engine.

12. The engine control system of claim 1 wherein said pedal torque estimator generates said desired pedal torque signal based on engine rpm and non-idle throttle area.

13. The engine control system of claim 1 wherein said torque loss estimator includes:

a deactivated vacuum estimator that generates a deactivated vacuum estimate signal based on activated vacuum;

an activated vacuum estimator that generates an activated vacuum estimate signal based on deactivated vacuum;

a sixth switch that selects one of vacuum and said deactivated vacuum estimate based on an operating mode of said engine;

a seventh switch that selects one of vacuum and said activated vacuum estimate based on said operating mode of said engine;

a deactivated pumping torque estimator that generates a deactivated pumping torque signal based on an output of said sixth switch;

a first hold circuit that holds said deactivated pumping torque signal;

an activated pumping torque estimator that estimates activated pumping torque based on an output of said seventh switch;

a second hold circuit that holds said activated pumping torque signal; and an eighth switch that selects one of said deactivated and said activated pumping torque signal.

14. A method for smoothing torque during transitions in a displacement on demand engine, comprising:

generating a torque loss signal based on torque loss due to at least one of friction, pumping and accessories;

generating a desired pedal torque signal;

generating a desired idle torque signal; and generating a difference between said desired pedal torque signal and said desired idle torque and said torque loss signals to provide a desired brake torque signal.

15. The method of claim 14 further comprising:

selecting one of activated and deactivated modes for said torque loss estimator based on an operating mode of said engine.

16. The method of claim 14 further comprising:

selecting one of activated and deactivated modes for said idle torque estimator based on an operating mode of said engine.

17. The method of claim 16 further comprising:

summing said desired brake torque signal and said torque loss signal for said deactivated mode to provide a first sum; and multiplying said first sum and an air per cylinder (APC) correction signal to produce a first desired deactivated indicated torque signal.

18. The method of claim 17 further comprising:

multiplying said first sum and a throttle area correction signal to produce a second desired deactivated indicated torque signal.

19. The method of claim 18 further comprising:

summing said desired brake torque signal and said torque loss signal for said activated mode to provide a second sum; and multiplying said second sum and said APC correction signal to produce a first desired activated indicated torque signal.

20. The method of claim 19 further comprising:

multiplying said second sum and said throttle area correction signal to produce a second desired activated indicated torque signal.

21. The method of claim 20 further comprising:

estimating a desired deactivated APC from said first deactivated desired indicated torque signal;

estimating a desired activated APC from said first desired activated indicated torque signal; and selecting one of said desired deactivated APC signal and said desired activated APC signal based on said operating mode of said engine.

22. The method of claim 21 further comprising:

estimating a desired deactivated area from said second deactivated desired indicated torque signal;

estimating a desired deactivated area from said second activated desired indicated torque signal; and selecting one of said desired deactivated area signal and said desired activated area signal based on said operating mode of said engine.

23. The method of claim 14 wherein estimating said idle airflow includes:

generates idle airflow signals for activated and deactivated modes based on engine rpm and idle airflow;

generating a deactivated idle torque signal based on said deactivated idle airflow signal;

generating an activated idle torque signal based on said activated idle airflow signal; and selecting one of said activated and deactivated idle airflow signals based on an operating mode of said engine.

24. The method of claim 14 further comprising generating said desired pedal torque signal based on engine rpm and non-idle throttle area.

25. The method of claim 24 wherein generating said torque loss signal includes:

generating a deactivated vacuum estimate signal based on activated vacuum;

generating an activated vacuum estimate signal based on deactivated vacuum;

using a sixth switch to selects one of vacuum and said deactivated vacuum estimate based on an operating mode of said engine;

using a seventh switch to selects one of vacuum and said activated vacuum estimate based on said operating mode of said engine;

generating a deactivated pumping torque signal based on an output of said sixth switch;

holding said deactivated pumping torque signal;

estimating activated pumping torque based on an output of said seventh switch;

holding said activated pumping torque signal; and using an eighth switch to selects one of said deactivated and said activated pumping torque signal.

* * * * *